US007510033B2

(12) United States Patent
Lutzhöft et al.

(10) Patent No.: US 7,510,033 B2
(45) Date of Patent: Mar. 31, 2009

(54) APPARATUS FOR VERTICALLY SUPPORTING PIPES

(75) Inventors: Jens Lutzhöft, Hamburg (DE); Jörn Grotherr, Halstenbek (DE)

(73) Assignee: Blohm + Voss Repair GmbH, Hamburg (DE)

( * ) Notice: Subject to any disclaimer, the term of this patent is extended or adjusted under 35 U.S.C. 154(b) by 65 days.

(21) Appl. No.: 11/357,932

(22) Filed: Feb. 17, 2006

(65) Prior Publication Data

US 2007/0163807 A1 Jul. 19, 2007

(30) Foreign Application Priority Data

Jan. 18, 2006 (DE) ..... 10 2006 002 293

(51) Int. Cl.
*E21B 19/10* (2006.01)

(52) U.S. Cl. ..... 175/423; 166/77.53

(58) Field of Classification Search ..... 175/423; 166/77.53

See application file for complete search history.

(56) References Cited

U.S. PATENT DOCUMENTS

| | | | | |
|---|---|---|---|---|
| 2,493,556 | A * | 1/1950 | Stone | 285/123.7 |
| 2,689,139 | A * | 9/1954 | Jones et al. | 285/123.8 |
| 5,042,601 | A * | 8/1991 | Penisson | 175/423 |
| 6,394,201 | B1 * | 5/2002 | Feigel et al. | 175/423 |
| 2004/0251055 | A1 * | 12/2004 | Shahin et al. | 175/423 |

* cited by examiner

*Primary Examiner*—William P Neuder
(74) *Attorney, Agent, or Firm*—Friedrich Kueffner

(57) ABSTRACT

An apparatus for vertically supporting pipes in oil production rigs. The apparatus includes an outer frame and a centering device. In the area of an inner side of the outer frame, at least one wedge device is provided for clamping the pipe. The outer frame is connected to the centering device so as to be vertically aligned and facing upwardly. A wedge device may additionally include a positioning device and a carrier provided with at least one wedge.

15 Claims, 16 Drawing Sheets

APPARATUS FOR VERTICALLY SUPPORTING PIPES

BACKGROUND OF THE INVENTION

1. Field of the Invention

The present invention relates to an apparatus for vertically supporting pipes in oil production rigs, wherein the apparatus includes an outer frame and a centering device.

2. Description of the Related Art

Apparatus of the above-described type are used particularly on off-shore drilling platforms in order to lower the necessary pipes when carrying out drilling procedures. It is necessary in that process to clamp the pipes at certain points in time from the outside and to secure the pipes and, at other times, to release the clamping action and to lower the pipes for carrying out a lowering process.

Apparatus which have become previously known are not sufficiently able in a simple manner to vertically support pipes with different diameters and to carry out a support of pipes which are long and, thus, very heavy.

SUMMARY OF THE INVENTION

Therefore, it is the primary object of the present invention to construct an apparatus of the above-described type in such a way that it can be universally used.

In accordance with the present invention, at least one wedge device for clamping the pipe is arranged in the area of an inner side of the outer frame.

The arrangement of the wedge device in the area of the inner side of the outer frame makes it possible in a simple manner to clamp and release the pipe by a vertical movement of the wedge device. The wedge device clamps the pipe relative to the outer frame. It is possible in particular to use in a simple manner wedge devices having different sizes in the outer frame and, thus, to effect an adjustment to different outer diameters of the pipes, wherein these procedures take little time and material. In particular, it is not necessary to exchange large and heavy structural components.

Putting in place a pipe from the side is made possible by constructing the outer frame of several parts.

In particular, the outer frame may be constructed of two parts. For providing a high mechanical load bearing capacity in a radial direction, it is proposed that the parts of the outer frame are mechanically connected to each other.

Placing the pipe in the support device from the side is made easier and the manipulation is simultaneously simpler by providing the outer frame with an access door.

An alignment of the pipe relative to the support apparatus is made possible by the fact that the outer frame is connected to the centering device in the area of its vertically upwardly directed extension.

Placing the pipe in the support apparatus is also facilitated by constructing the centering device of several parts.

In particular, the centering device is constructed of two parts.

The manipulation by means of lifting devices is made possible by the fact that the centering device is slewable and connected to the outer frame.

The support of the pipes with high support forces is achieved by providing the wedge device with a positioning device and at least one carrier provided with at least one wedge.

For an adaptation to pipes to be supported having different sizes, a particular feature provides that the outer frame is optionally provided with a wedge device selected from a set of wedge devices having different sizes.

Also, contributing to the universal construction of the apparatus is the fact that the carrier is selected from a set of carriers having different sizes.

A positioning at high force applications is facilitated by providing the positioning device of the wedge device with at least one hydraulic cylinder for setting the position.

The parts can be secured by attaching at least two wedges to the carrier using at least one support element.

A clamping action without play is achieved by providing the wedge device with three carriers.

A maintenance-free long-term operability is facilitated by connecting the wedge device to a central lubricant supply.

A further improvement of the universal utility of the apparatus for different pipe sizes and different pipe weights can be achieved by providing the outer frame on an outer side thereof with at least one outer adapter for size adjustments.

Moreover, a simple manipulation is effected by providing guide recesses for receiving hinge bolts for connecting the access door to the other frame, wherein the guide recesses have a length which is greater than a width thereof.

The various features of novelty which characterize the invention are pointed out with particularity in the claims annexed to and forming a part of the disclosure. For a better understanding of the invention, its operating advantages, specific objects attained by its use, reference should be had to the drawing and descriptive matter in which there are illustrated and described preferred embodiments of the invention.

DETAILED DESCRIPTION OF THE INVENTION

Figure 1:
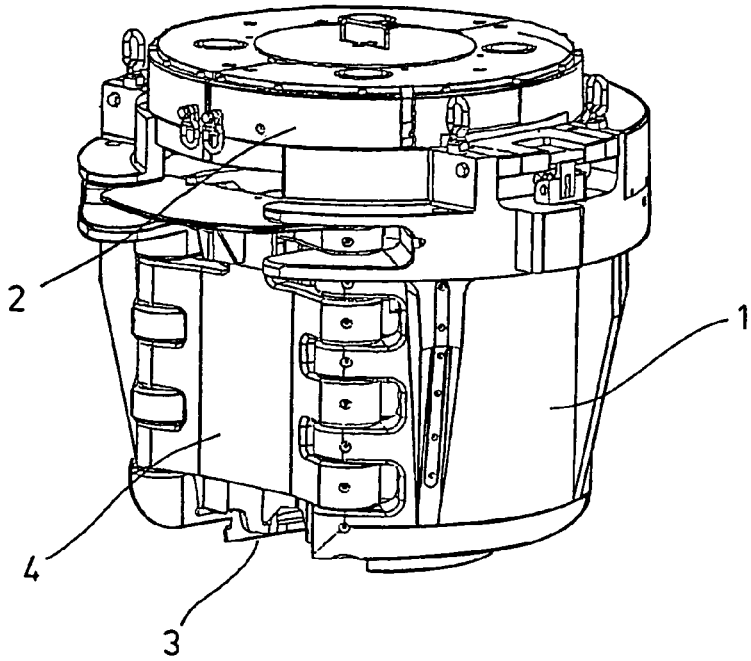
FIG. 1 is a perspective side view of an outer frame with closed access door and with a closed centering device.

FIG. 1 of the drawing shows a perspective view of an apparatus for vertically supporting a pipe, not shown. The apparatus includes an outer frame 1 and a centering device 2. The centering device 2 is arranged vertically aligned above the outer frame 1. The outer frame 1 is essentially U-shaped and defines an access opening 3. The access opening 3 can be closed by an access door 4.

Figure 2:
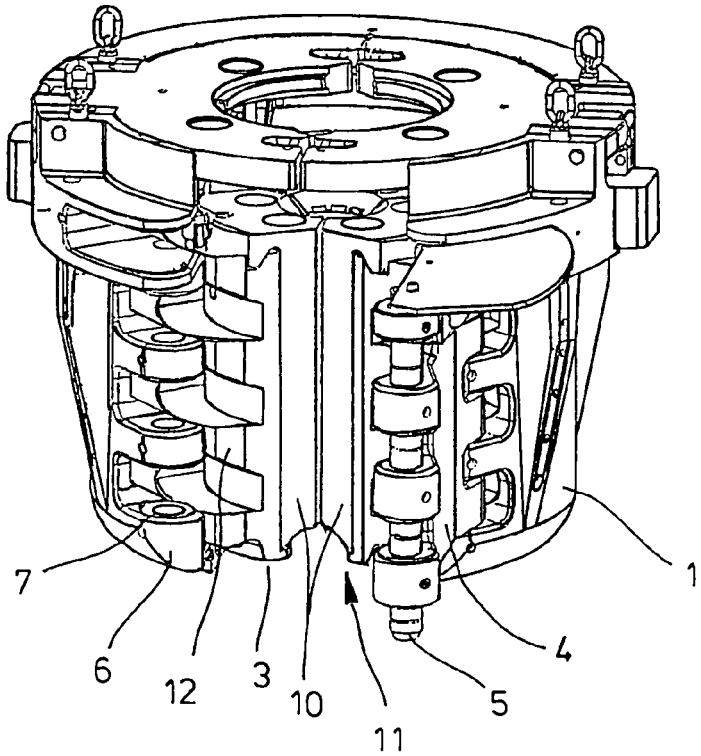
FIG. 2 is a perspective side view of the outer frame of FIG. 1 shown with the centering device removed and the access door open.

FIG. 2 shows the apparatus of FIG. 1 after the centering device 2 has been removed and the access door 4 has been opened. FIG. 2 particularly shows a hinge bolt 5 of the access door 4 which is guided in projections 6 of the access door 4, wherein the projections 6 are provided with guide recesses 7. In the closed state of the access door 4, the projections 6 of the access door 4 mesh in the manner of a comb in projections 8 of the outer frame 1. The projections 8 also have guide recesses 9.

For carrying out a closing procedure of the access door 4, the hinge bolt 5 is pulled out of the guide recesses 7 of the projections 6 and, after the access door 4 has been closed, the hinge bolt 5 is pushed through all guide recesses 7, 9 of the projections 6, 8.

When opening and closing the access door 4, a second hinge bolt 5 advantageously remains in the area of the corresponding guide recesses 7, 9 and forms a rotary hinge as a result.

FIG. 2 shows carriers 10 of a wedge device 11. The wedge device 11 additionally has a positioning device 12 which supports the carriers 10 and is mounted so as to be movable relative to the outer frame 1 in a vertical direction.

Figure 3:
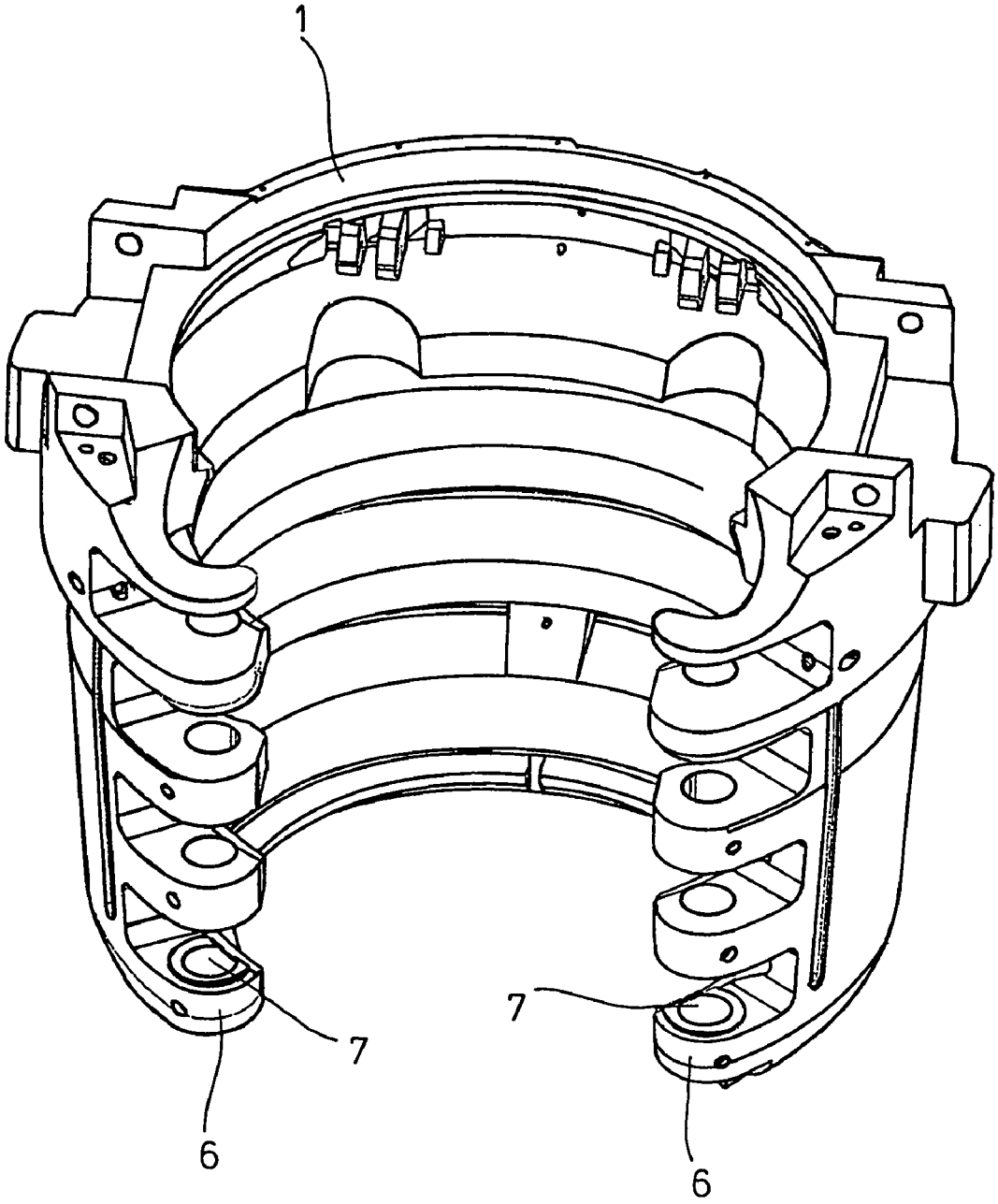
FIG. 3 is a perspective view of the outer frame of FIG. 1.

FIG. 3 is a perspective view of the outer frame 1 with the access door 4 removed. Viewable as a result are projections 13 with guide recesses 14 for the hinge bolts 5. In the closed state, the projections 13 of the access door 4 mesh with the projections 8 of the outer frame 1.

Figure 4:
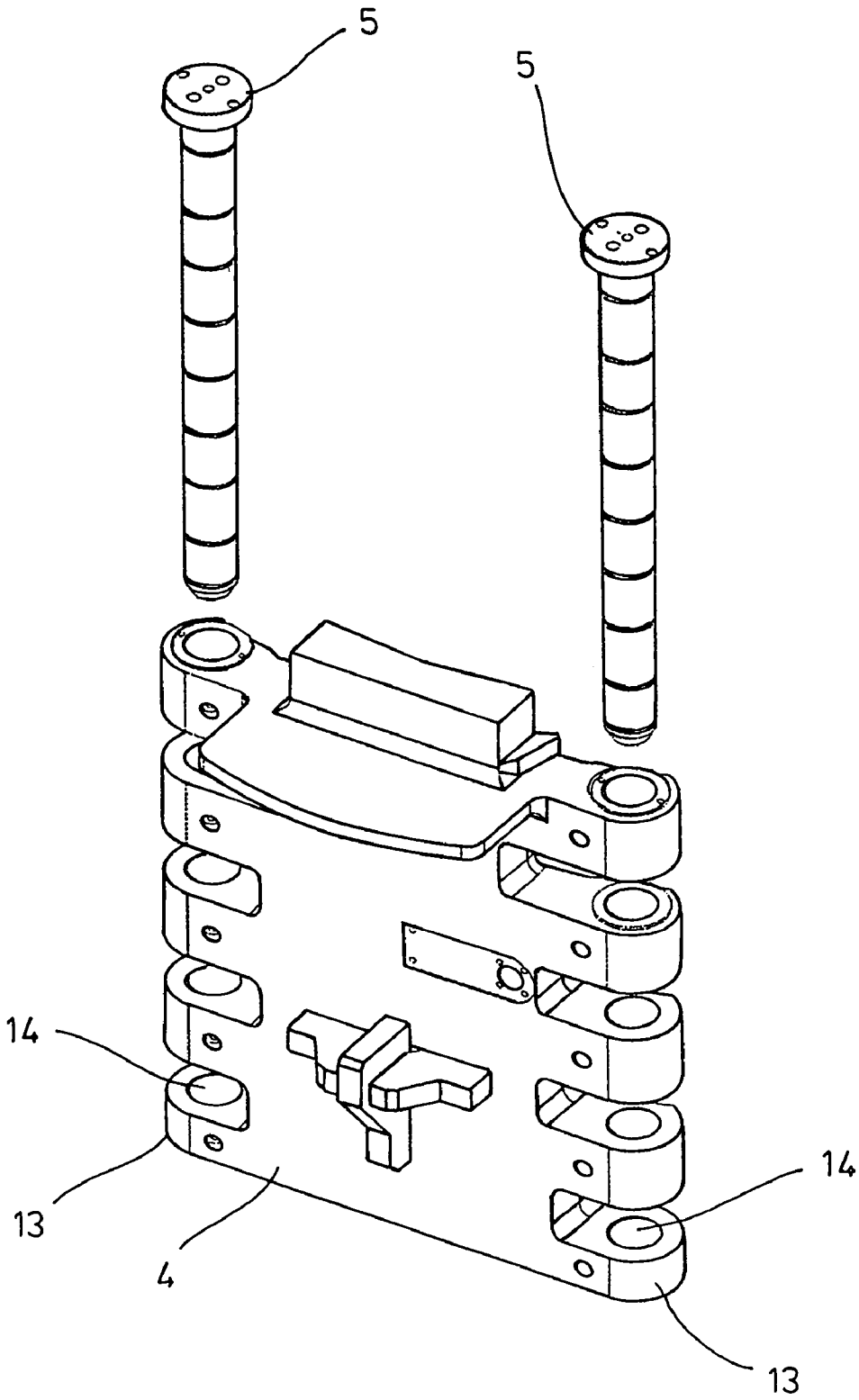
FIG. 4 is a perspective view of the access door of FIG. 1 shown with hinge bolts removed.

FIG. 4 shows the access door 4 with pulled-out hinge bolts 5. This makes visible projections 13 with guide recesses 14 for the hinge bolts 5. In a closed state, the projections 13 of the access door 4 mesh with the projections 8 of the outer frame 2.

Figure 5:
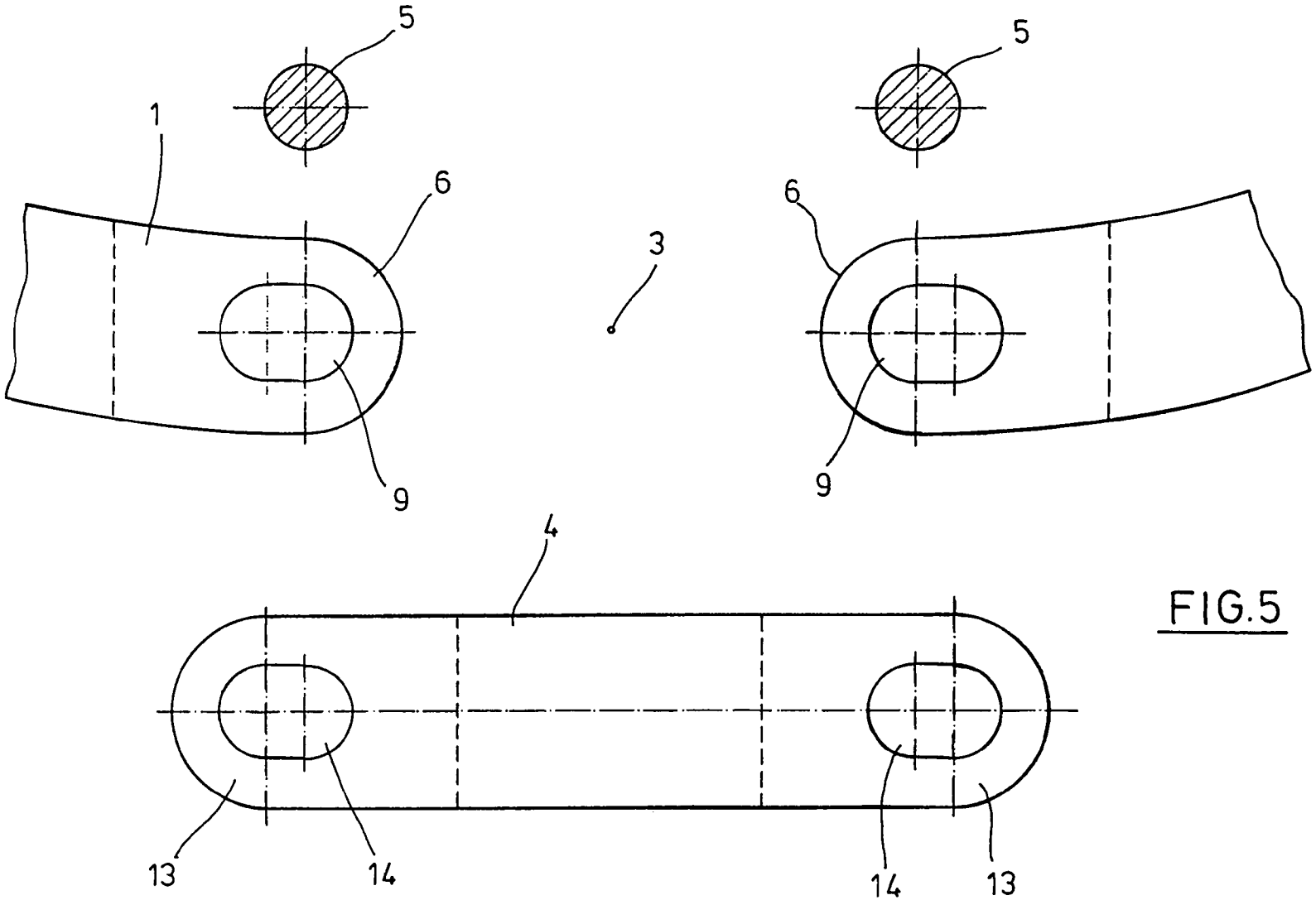
FIG. 5 is a partial top view, on a larger scale, of the outer frame with the access door for illustrating the support sleeves for the hinge bolts.

FIG. 5 is a partial illustration on a significantly larger scale, showing in a top view an access door 4 which is arranged in the area of the access opening 3. FIG. 5 shows the state of assembly before the projections 13 of the access door 4 have been engaged with the projections 8 of the outer frame 1. It can particularly be seen that the guide recesses 9, 14 have an essentially oval cross-section. As a result, the hinge bolts 5, which have an essentially circular cross-section, can be inserted with play into the guide recesses 9, 14 and a mechanical clamping action can be effected by an activation of the wedge device 11 which occurs by a vertical displacement of the positioning device 12.

Figure 6:
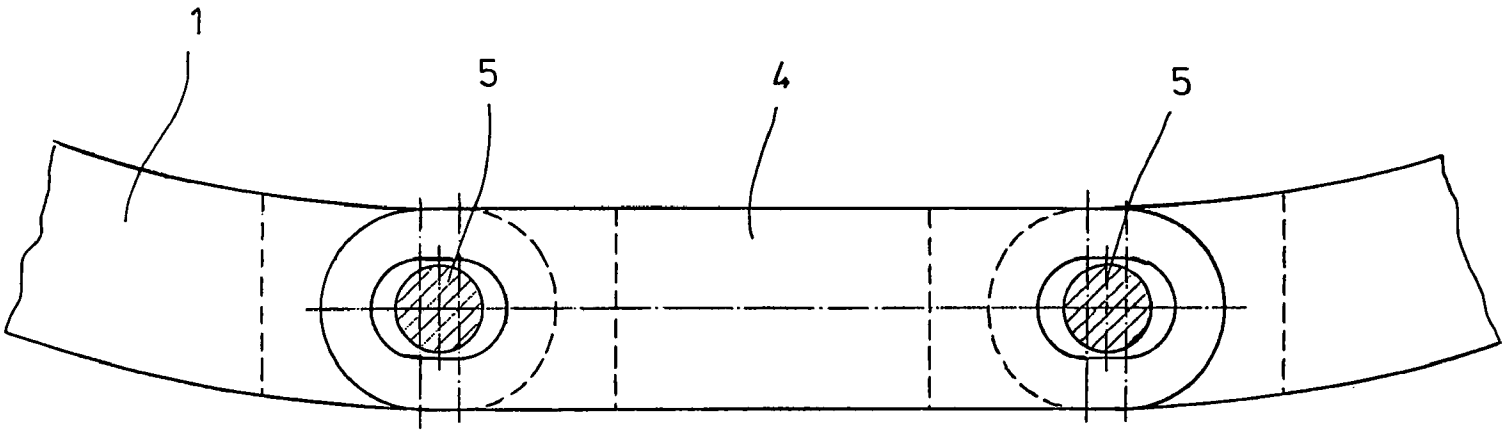
FIG. 6 is a view similar to FIG. 5, shown with inserted access door and the hinge bolts in an untensioned state.

FIG. 6 shows the outer frame 1 with the access door 4 in place prior to carrying out clamping of the wedge device 11 which is not illustrated in the Figure. It can be seen that the hinge bolt 5 is mounted with play.

Figure 7:
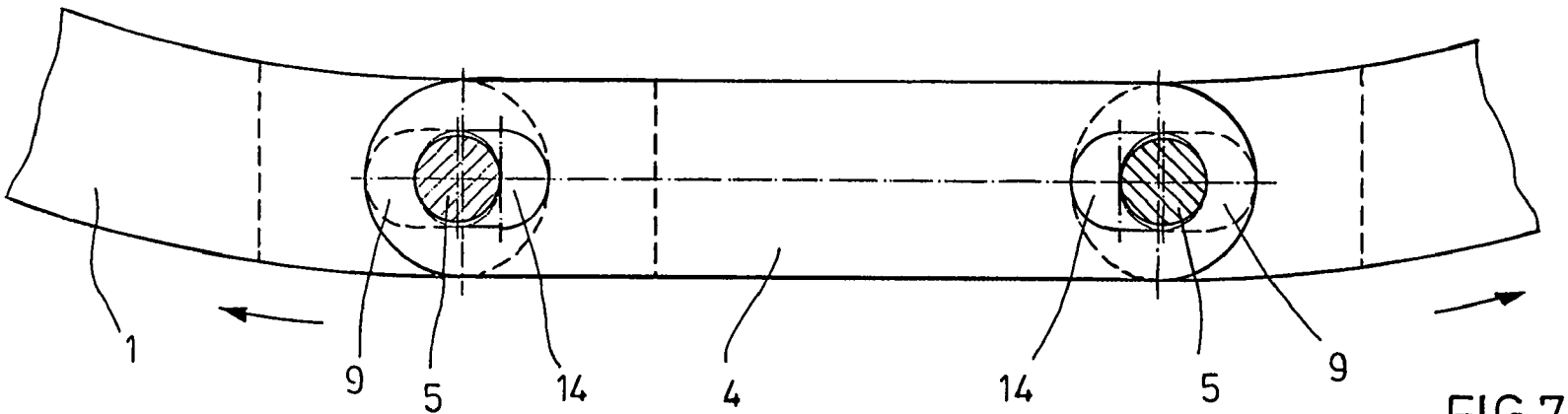
FIG. 7 shows the arrangement of FIG. 6 after tensioning by wedging a pipe to be supported.

FIG. 7 shows the device of FIG. 6 after clamping has been performed. The hinge bolts 5 successively rest against the oppositely located limiting surfaces of the guide recess 9, 14.

Figure 8:
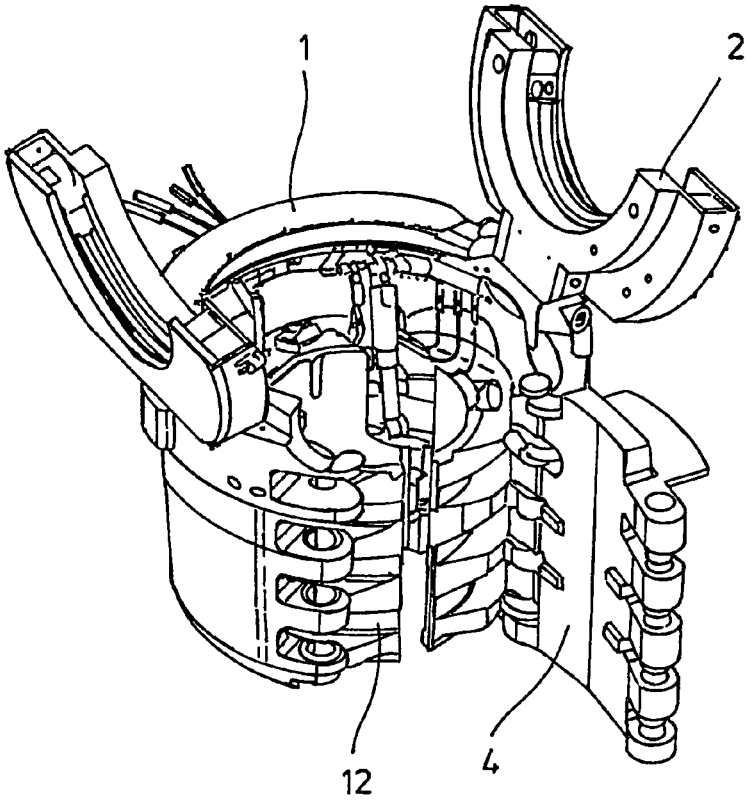
FIG. 8 is a perspective view of an outer frame with the centering device being folded up and the access door being open.

FIG. 8 is a perspective view similar to FIG. 2 with the centering device 2 being mounted and open. In accordance with this embodiment, the centering device 2 is formed of two semicircular segments which can each be pivoted with the outer frame 1. The access door 4 is shown opened and this makes it possible to see the positioning device 12.

Figure 9:
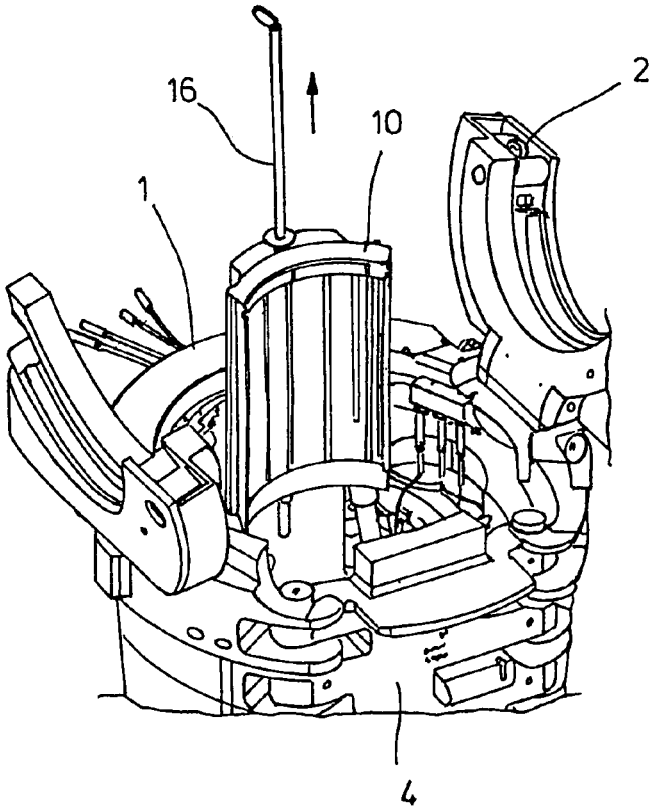
FIG. 9 is a partial view of the arrangement of FIG. 8 with the access door being closed with a carrier being inserted in the wedge device.

FIG. 9 is a partial illustration of the device of FIG. 8 shown after a partial disassembly of one of the carrier 10 supported by the positioning device 12 by using the tool 16. The carrier 10 is pulled out in the vertical direction and upwardly out of the positioning device 12 by using the tool 16.

Figure 10:
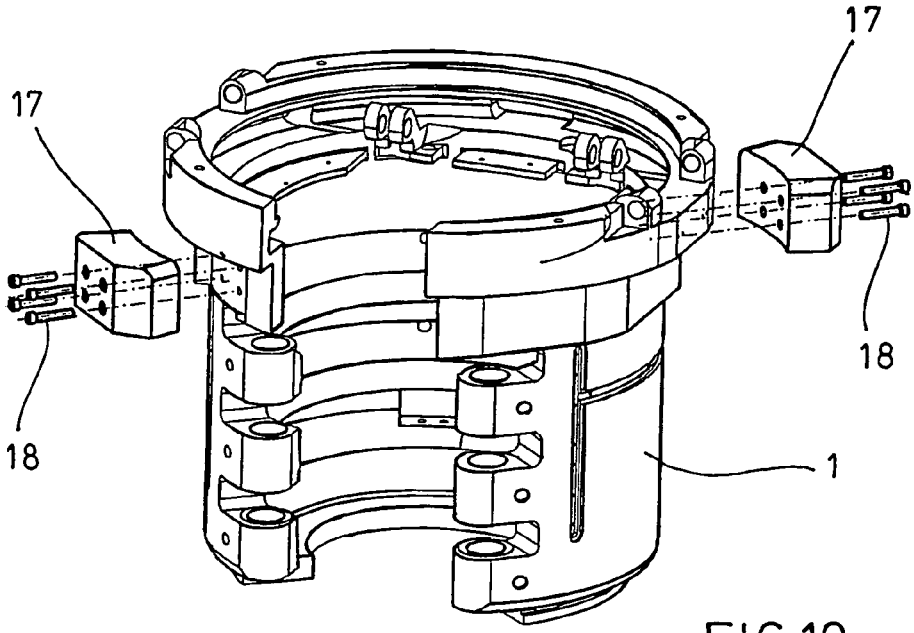
FIG. 10 is a perspective view of the outer frame for illustrating the use of outer adapter pieces.

FIG. 10 of the drawing shows an illustration of the outer frame 2 similar to FIG. 3, however, with outer adapters 17 being disassembled. By using the outer adapters 17 it is possible to insert differently dimensioned outer frames 1 in uniformly dimensioned receiving devices which are installed in the area of drilling platforms.

Figure 11:
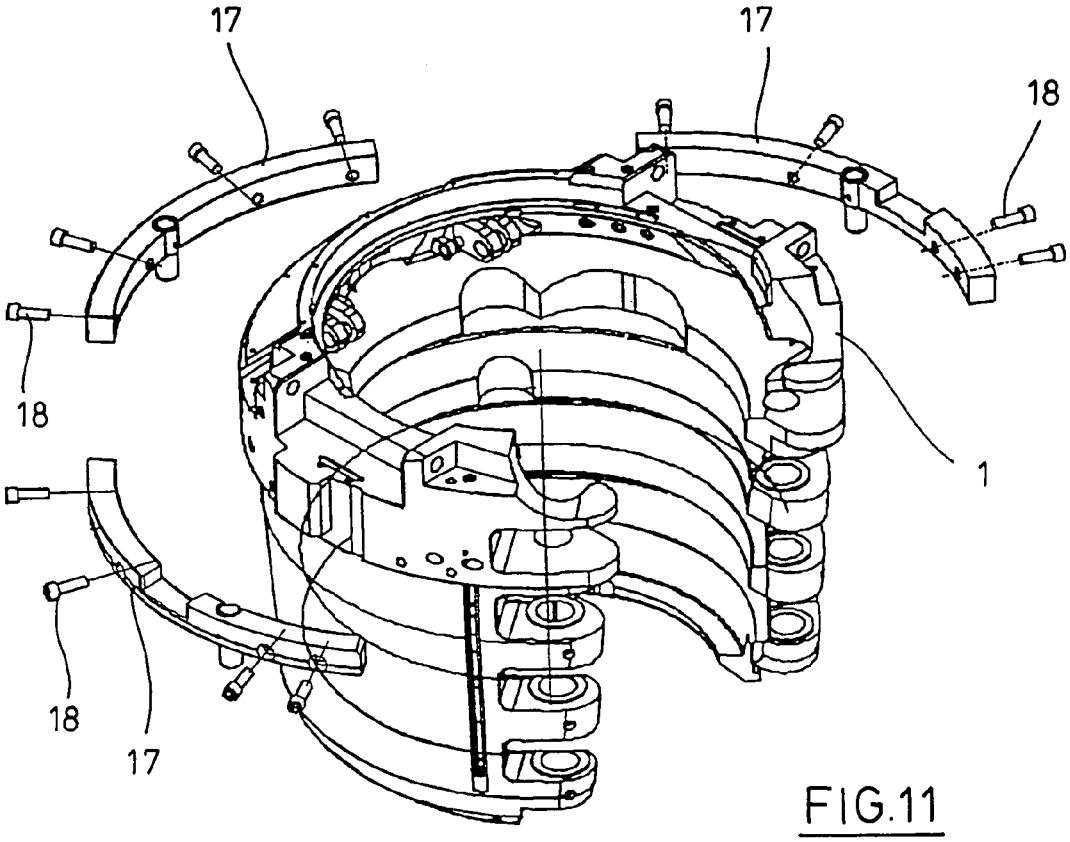
FIG. 11 is an illustration similar to FIG. 10 for illustrating the use of outer adapter ring segments.

FIG. 11 shows an embodiment which is modified compared to the embodiment of FIG. 10, wherein the outer adapters 17 are not constructed in the manner of a block, as seen in FIG. 10, but in the manner of circular segments. Advantageously, the outer adapters 17 shown in FIG. 10 as well as in FIG. 11 are fastened to the outer frame 1 by means of bolts 18.

Figure 12:
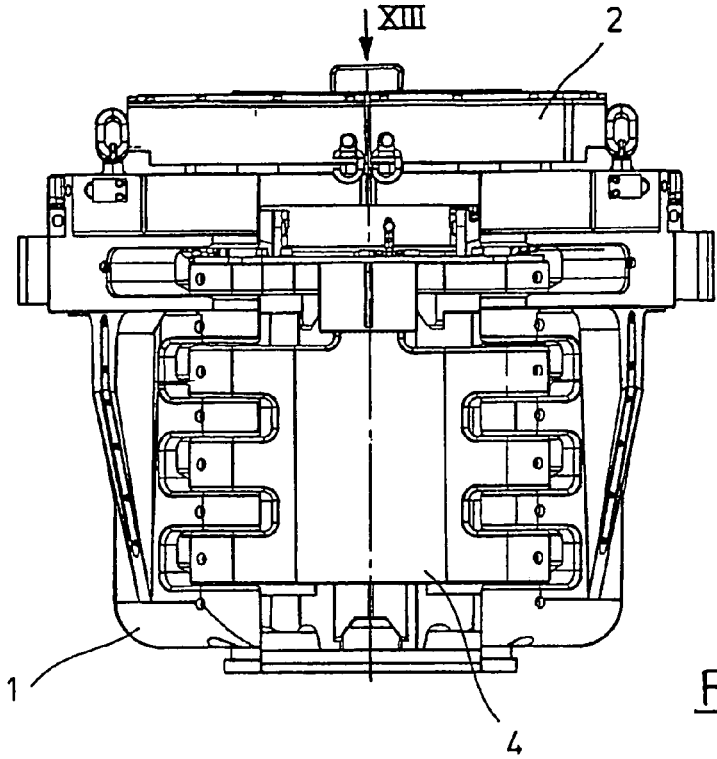
FIG. 12 is a side view of an outer frame with the access door being closed and a centering device placed on the outer frame.

FIG. 12 is a side view of the device of FIG. 4 in a viewing direction toward the front of the access door 4. This essentially illustrates the symmetric configuration of the total apparatus.

Figure 13:
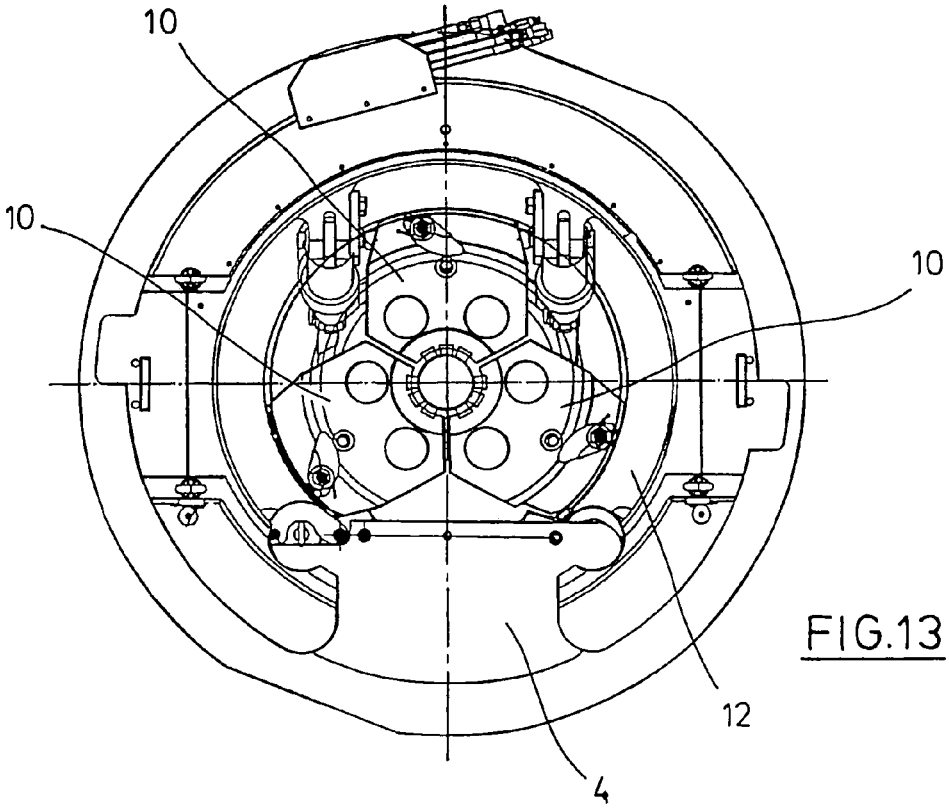
FIG. 13 is a top view in the viewing direction XIII in FIG. 12.
Figure 14:
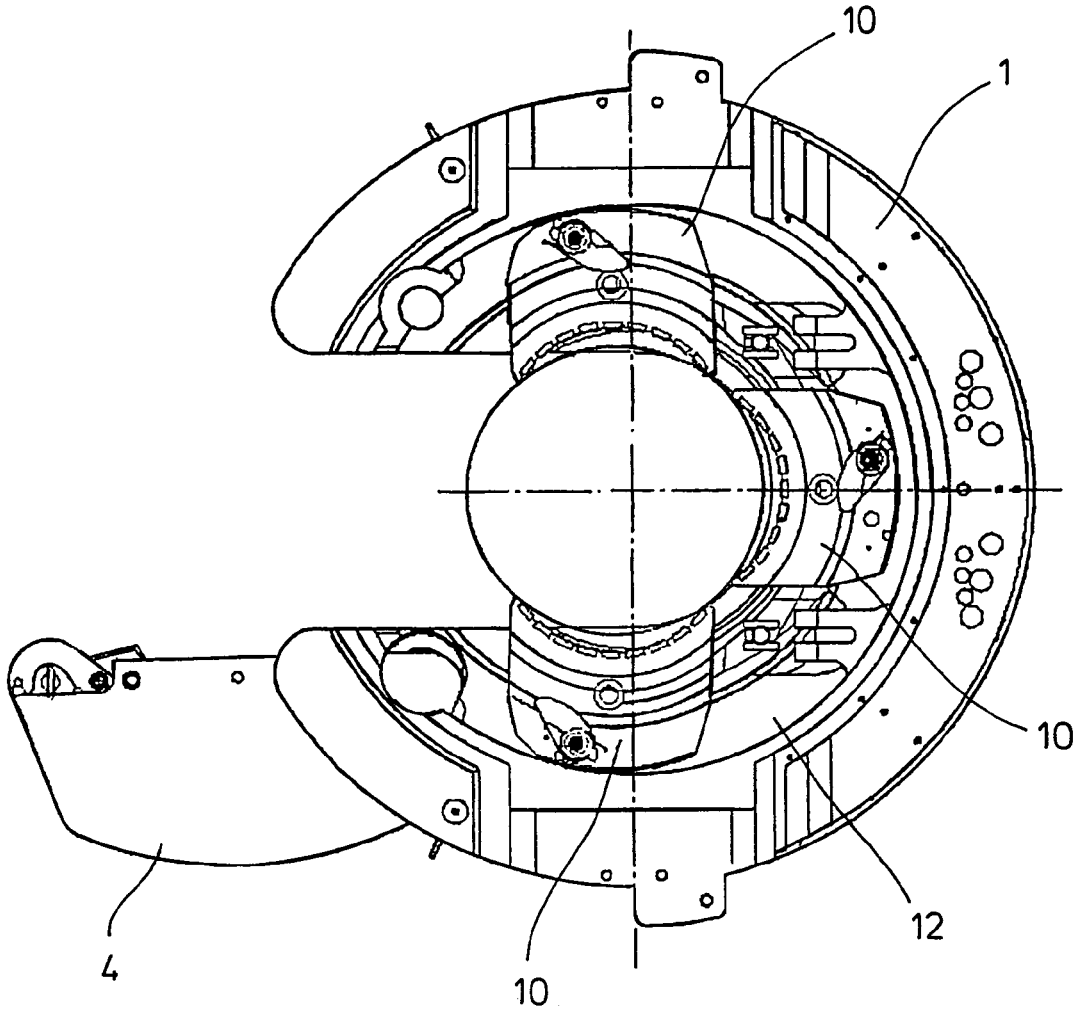
FIG. 14 is an illustration similar to FIG. 13 with the access door being open.

The top view of FIG. 13 shows the arrangement of three carriers 10 within the positioning device 12. FIG. 14 shows a top view with the access door 4 being opened.

Figure 15:
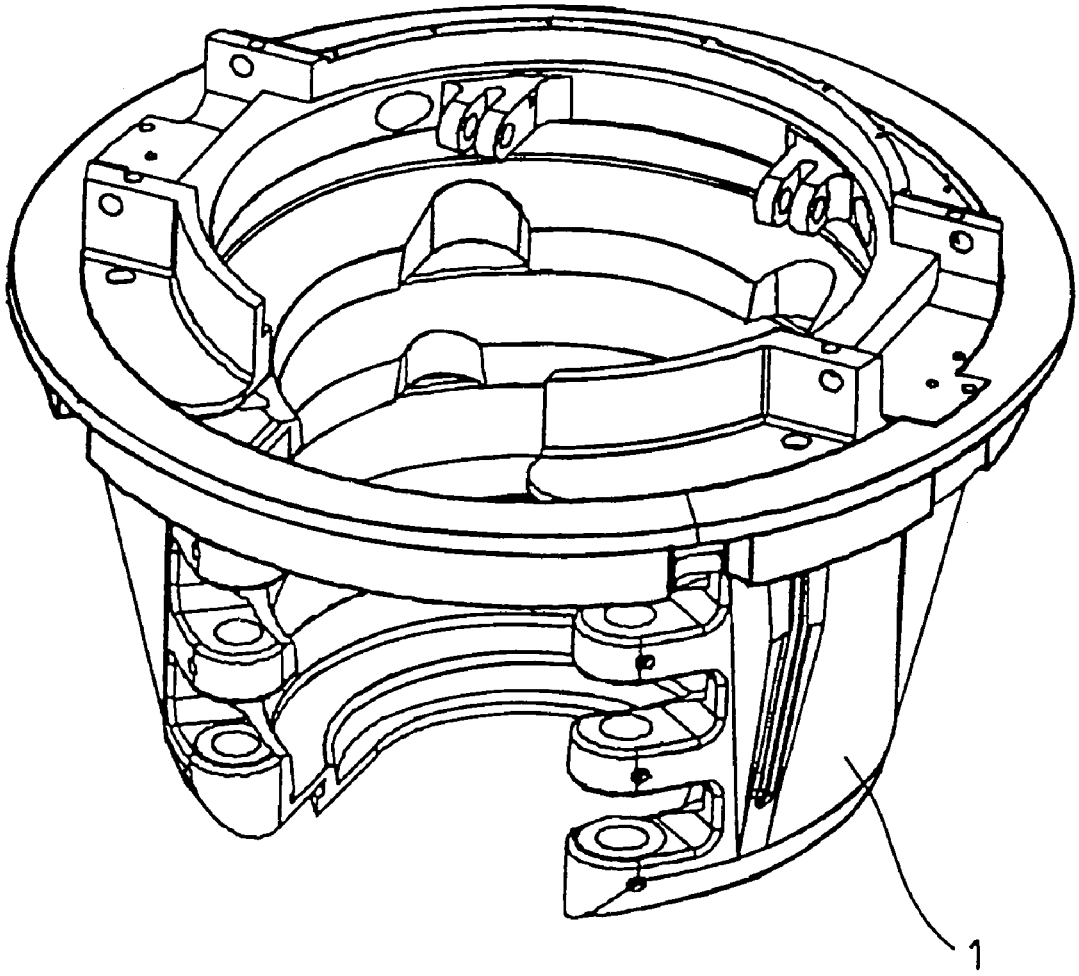
FIG. 15 is another perspective illustration of an outer frame with the access door being removed and an outer adapter ring being used.
Figure 16:
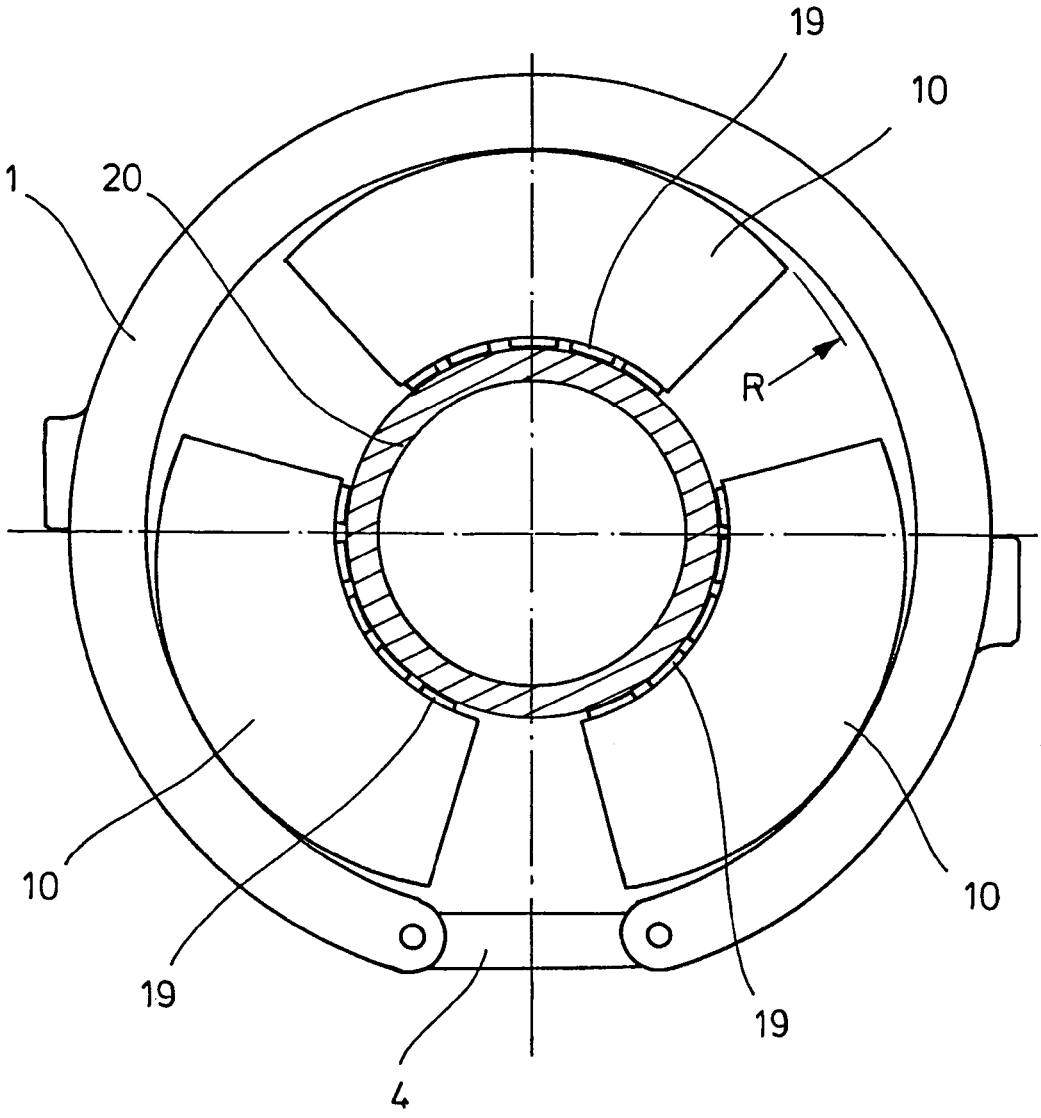
FIG. 16 is a schematic top view of an outer frame with the access door being closed and with a wedge device with three carriers.

FIG. 15 shows another illustration of the outer frame 1 without the access door 4 being in place and with the use of an outer adapter ring. FIG. 16 once again illustrates in a top view the outer frame 1 with the access door 4 being closed and three carriers 10 being used. Each of the carriers 10 supports a plurality of wedges 19 which serve for securing a pipe 20.

Figure 17:
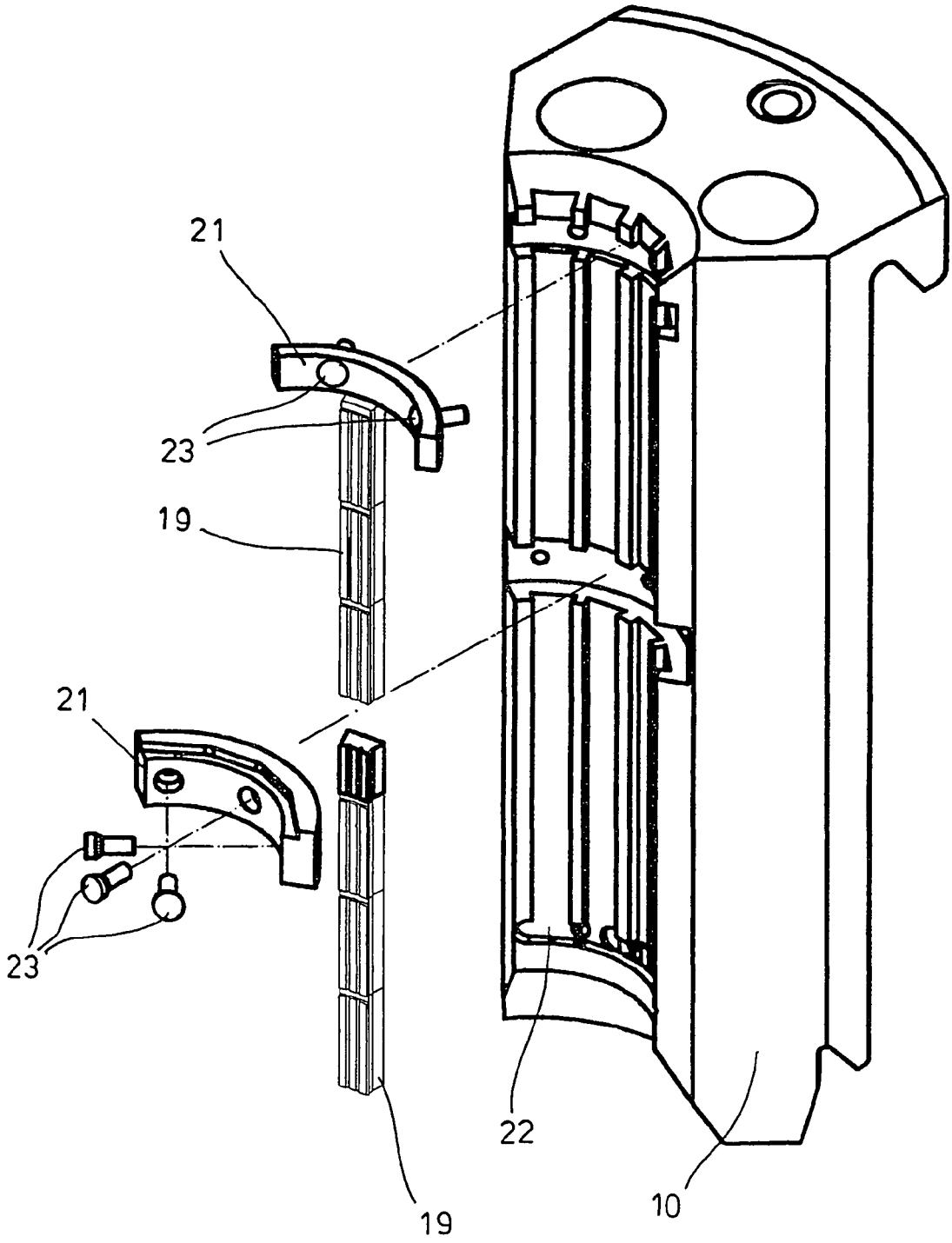
FIG. 17 is a perspective view of a carrier of the wedge device with appropriate wedges and adapter segments.

FIG. 17 is an exploded view of a carrier 10 with its corresponding wedges 19 and support elements 21. The wedges 19 are placed in indentations 22 of the carrier 10 and are secured by the support elements 21. In the illustrated embodiment, always two wedges 19 are arranged in pairs one above the other. In addition, a row of wedges 19 are arranged next to each other. This results in two rows of wedges 19 which are arranged one above the other and are separated from each other by a support element 21. Additional support elements 21 are arranged in the area of ends of the ridges 19 which are facing away from each other and which serve for further securing the wedges 19 at the carrier 10.

Figure 18:
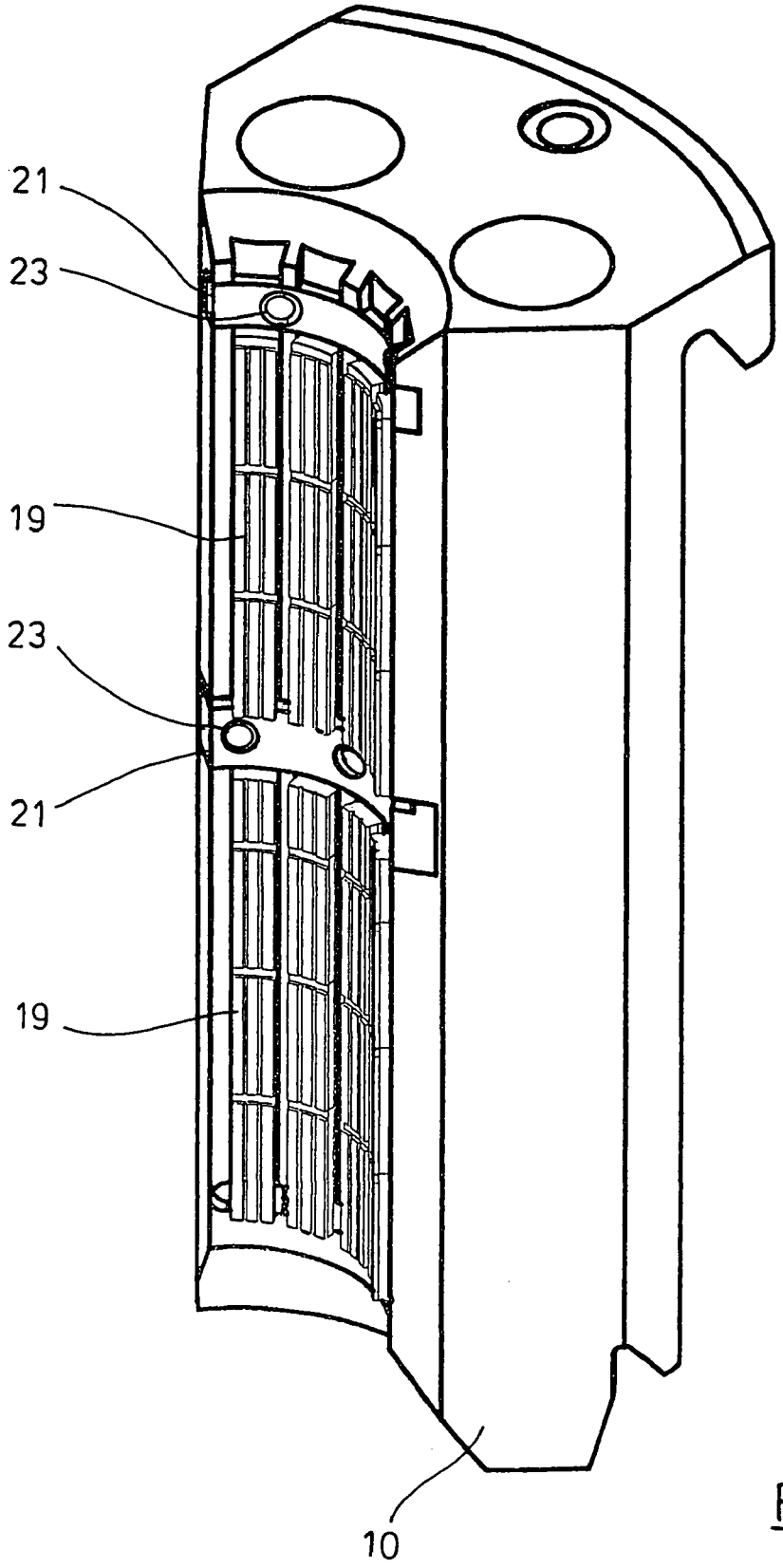
FIG. 18 is a view of the carrier according to FIG. 17 after the insertion of the wedges and the adapter segments.

FIG. 18 shows the device of FIG. 17 after the components have been assembled. The support elements 21 are secured with the use of bolts 23 at the carrier 10.

Figure 19:
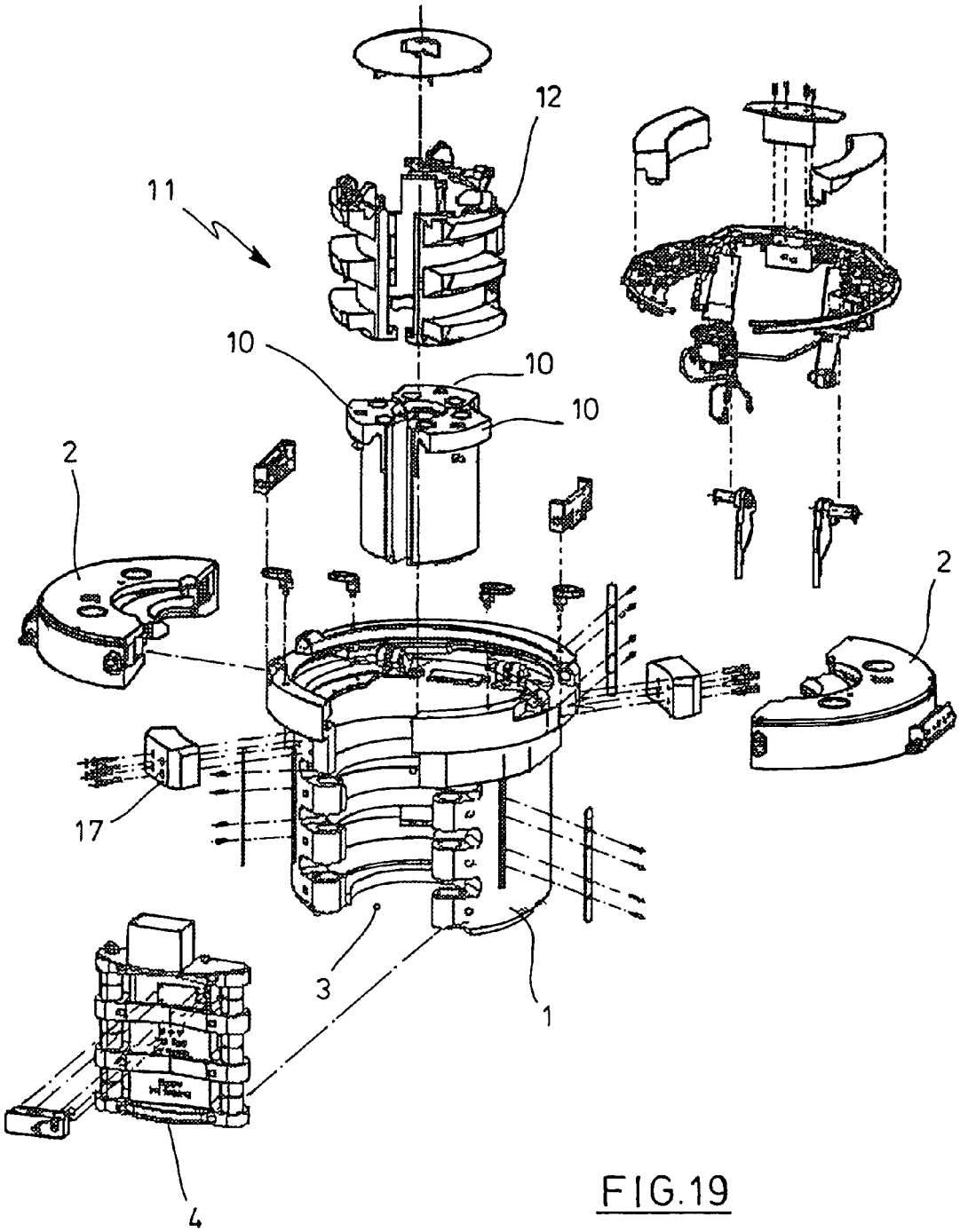
FIG. 19 is an exploded view of an outer frame with the required access door, centering device, and carriers of the wedging device.

FIG. 19 is an exploded view of the total apparatus in order to illustrate the geometric arrangement of the individual components relative to each other.

Figure 20:
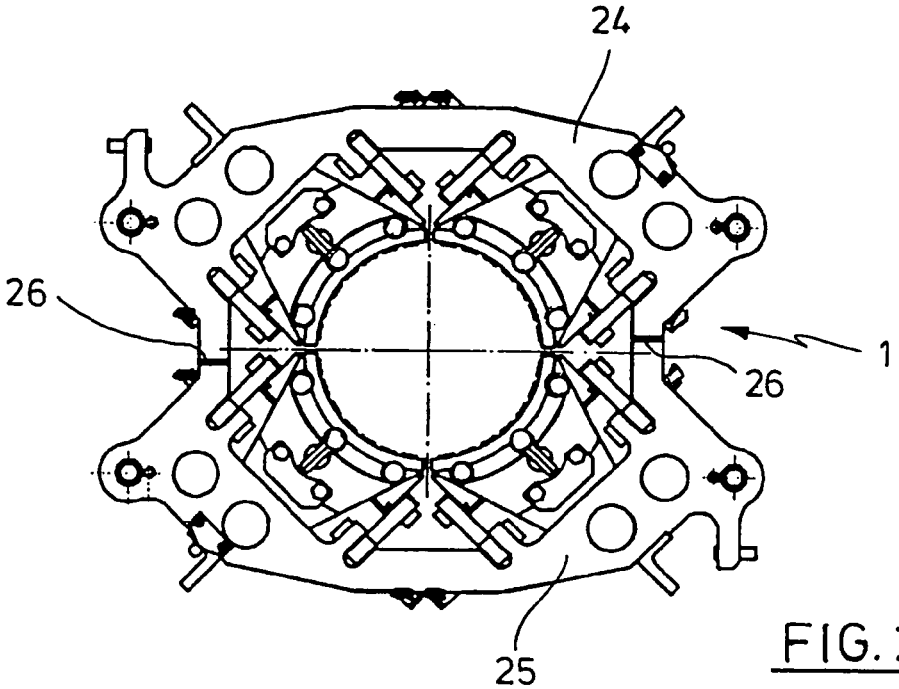
FIG. 20 is a top view of an apparatus with a dividable outer frame.

FIG. 20 shows an embodiment in which the outer frame 1 is formed of two frame segments of essentially the same size which may be connected to each other, for example, by screws. The frame segments 24, 25 contact each other in the area of a plane 26 of separation. This embodiment avoids the use of a separate access door 4. Four holding wedges are being used.

Figure 21:
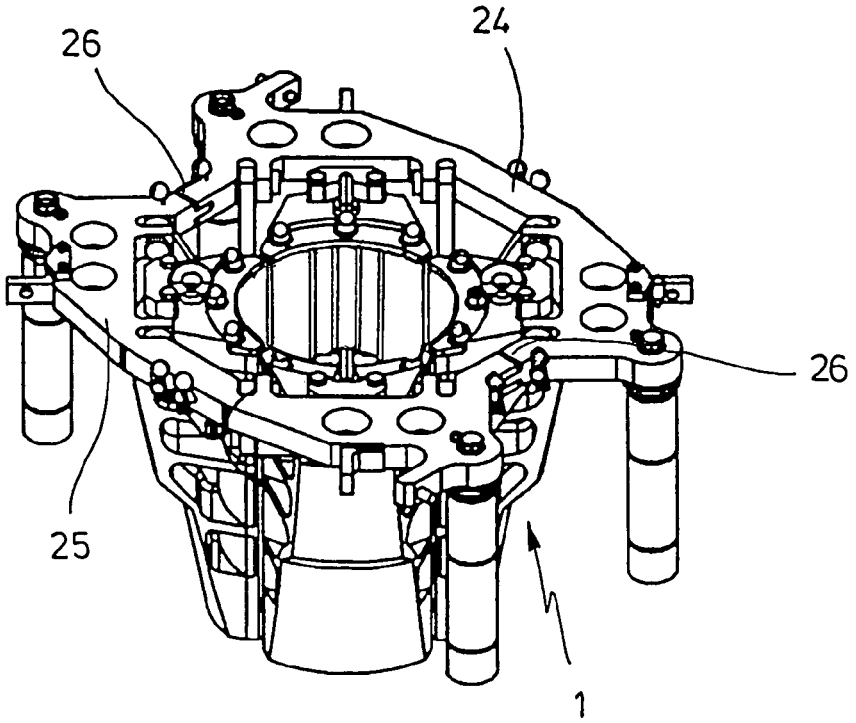
FIG. 21 is a perspective side view of the apparatus of FIG. 20.

FIG. 21 is a perspective view of the apparatus of FIG. 20.

Figure 22:
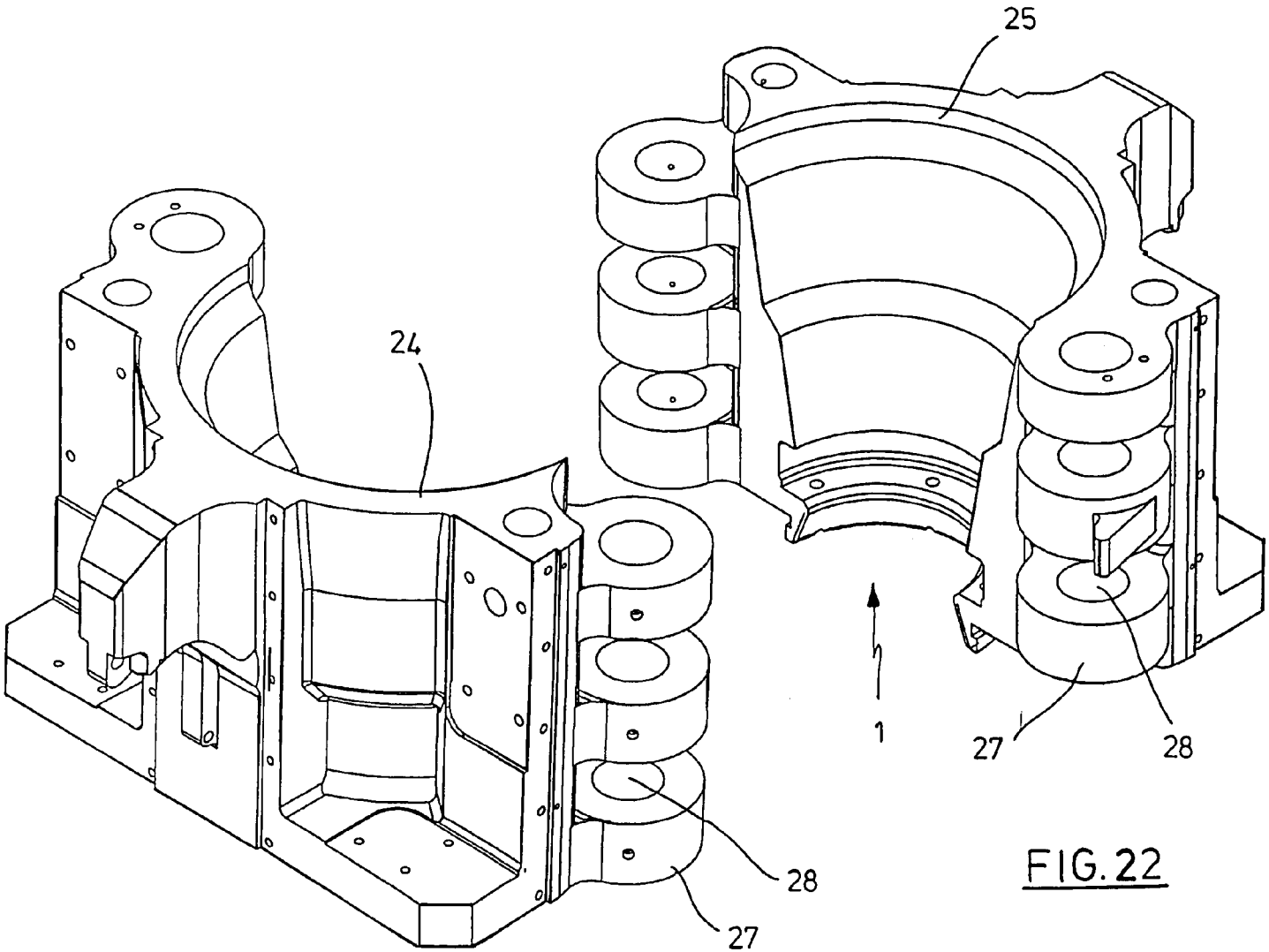
FIG. 22 is a perspective view of a dividable outer frame.

The perspective view of FIG. 22 shows another embodiment which uses two frame segments 24, 25. In this case, the frame segments 24, 25 are connected to each other essentially in accordance with the connecting principle according to FIG. 1. The frame segments 24, 25 have projections 27 which are provided with guide recesses 28 for locking bolts, not shown.

While specific embodiments of the invention have been shown and described in detail to illustrate the inventive principles, it will be understood that the invention may be embodied otherwise without departing from such principles.

We claim:

1. An apparatus for vertically supporting pipes in oil production rigs, the apparatus comprising an outer frame and a centering device, further comprising in an area of an inner side of the outer frame at least one wedge device for clamping the pipe, wherein the wedge device comprises a positioning device and at least three carriers each provided with at least one wedge, wherein the outer frame is provided with wedge devices selected from a set of different sized wedge devices.

2. The apparatus according to claim 1, wherein the outer frame is comprised of multiple parts.

3. The apparatus according to claim 1, wherein the outer frame is comprised of two parts.

4. The apparatus according to claim 1, wherein parts of the outer frame are mechanically connected to one another.

5. The apparatus according to claim 1, wherein the outer frame comprises an access door.

6. The apparatus according to claim 1, wherein the outer frame is connected to the centering device with the outer frame being aligned vertically and facing upwardly.

7. The apparatus according to claim 6, wherein the centering device is comprised of several parts.

8. The apparatus according to claim 7, wherein the centering device is comprised of two parts.

9. The apparatus according to claim 1, wherein the centering device is pivotally connected to the outer frame.

10. The apparatus according to claim 1, wherein the carrier is selected from a set of differently sized carriers.

11. The apparatus according to claim 1, wherein the positioning device of the wedge device comprises at least one hydraulic cylinder for positioning.

12. The apparatus according to claim 11, wherein at least two wedges are secured to the carrier by means of a support element.

13. The apparatus according to claim 1, wherein the wedge device is connected to a central lubricant supply.

14. The apparatus according to claim 1, wherein the outer frame has at least one outer adapter for size adjustment.

15. The apparatus according to claim 5, wherein pipe recesses for receiving hinge bolts connecting the access door to the outer frame have a length which is greater than a width thereof.

* * * * *